US005493791A

United States Patent [19]

Kramer

[11] Patent Number: 5,493,791

[45] **Date of Patent: * Feb. 27, 1996**

[54] ARTICLE OF FOOTWEAR HAVING IMPROVED MIDSOLE

[76] Inventor: Hy Kramer, 1457 Bassett Ave., Bronx, N.Y. 10461

[ * ] Notice: The portion of the term of this patent subsequent to Aug. 10, 2010, has been disclaimed.

[21] Appl. No.: 58,377

[22] Filed: May 10, 1993

Related U.S. Application Data

[63] Continuation of Ser. No. 766,913, Sep. 27, 1991, Pat. No. 5,233,767, which is a continuation of Ser. No. 477,732, Feb. 9, 1990, abandoned.

[51] Int. Cl.[6] ..... A43B 13/02; A43B 13/18

[52] U.S. Cl. ..... 36/28; 36/35 B; 36/3 B

[58] Field of Search ..... 36/28, 29, 71, 36/3 B, 30 R, 31, 35 R, 35 B, 37

[56] References Cited

U.S. PATENT DOCUMENTS

| | | | |
|---|---|---|---|
| 1,598,809 | 9/1926 | Dressel | 36/28 |
| 1,605,408 | 11/1926 | Huiskamp | 36/3 B |
| 1,605,588 | 11/1926 | Huiskamp | 36/25 R |
| 2,432,533 | 12/1947 | Margolin | 36/38 |
| 2,527,414 | 10/1950 | Hallgren | 36/32 R |
| 3,231,454 | 1/1966 | Williams | 36/3 R |
| 3,418,731 | 12/1968 | Anciaux | 36/30 |
| 4,316,332 | 2/1982 | Giese et al. | 36/28 |
| 4,364,186 | 12/1982 | Fukuoka | 36/38 |
| 4,462,171 | 7/1984 | Whispell | 36/29 |
| 4,521,979 | 6/1985 | Blaser | 36/28 |
| 4,608,768 | 9/1986 | Cavanagh | 36/28 |
| 4,685,224 | 8/1987 | Anger | 36/3 B |
| 4,733,483 | 3/1988 | Lin | 36/28 |
| 4,768,295 | 9/1988 | Ito | 36/28 |
| 4,782,603 | 11/1988 | Brown | 36/29 |
| 4,831,749 | 5/1989 | Tsai | 36/3 B |
| 4,843,741 | 7/1989 | Yung-Mao | 36/114 |
| 4,845,863 | 7/1989 | Yung-Mao | 36/114 |
| 4,864,738 | 9/1989 | Horovitz | 36/29 |
| 4,881,328 | 11/1989 | Yung-Mao | 36/28 |
| 4,918,838 | 4/1990 | Chang | 36/28 |
| 4,956,927 | 9/1990 | Misevich et al. | 36/32 R |
| 4,970,807 | 11/1990 | Anderie et al. | 36/28 |
| 4,979,345 | 12/1990 | Yung-Mao | 36/28 |
| 4,999,931 | 3/1991 | Vermeulen | 36/30 R |
| 5,086,574 | 2/1992 | Bacchiocchi | 36/35 R |
| 5,092,060 | 3/1992 | Frachey et al. | 36/29 |
| 5,233,767 | 8/1993 | Kramer | 36/28 |

FOREIGN PATENT DOCUMENTS

| | | | |
|---|---|---|---|
| 0215995 | 4/1987 | European Pat. Off. | 36/29 |
| 320993 | of 1989 | European Pat. Off. . | |
| 61906 | 4/1892 | Germany | 36/28 |
| 474016 | 3/1929 | Germany | 36/28 |
| 806647 | 8/1952 | Germany | 36/29 |
| 3635831 | 5/1988 | Germany | 36/28 |
| 9001492 | 5/1990 | Germany . | |
| 15421 | of 1899 | United Kingdom | 36/35 B |
| 2032761 | 5/1980 | United Kingdom . | |

*Primary Examiner*—Paul T. Sewell
*Assistant Examiner*—Ted Kavanaugh
*Attorney, Agent, or Firm*—Sughrue, Mion, Zinn, Macpeak & Seas

[57] ABSTRACT

A midsole, partial midsole, or the like, for inclusion in an article of footwear having a flexible, air-permeable top sole, characterized by at least one plug in the heel region having a thickness (height) sufficient to permit significant compression deformation along its thickness dimension accompanied by simultaneous significant bulging deformation in its circumscribing surface perpendicular to the thickness dimension; the deformations occurring solely due to normal walking activity by any wearer of the footwear; and the deformations thereby providing simultaneously for shock-absorption and ventilation during said normal walking activity.

13 Claims, 5 Drawing Sheets

ARTICLE OF FOOTWEAR HAVING IMPROVED MIDSOLE

This is a continuation of application Ser. No. 07/766,913 filed Sep. 27, 1991, now U.S. Pat. No. 5,233,767 which is a continuation of application Ser. No. 07/477,732 filed on Feb. 9, 1990, now abandoned.

BACKGROUND OF THE INVENTION

1. Field of the Invention

The present invention relates to improved articles of footwear, particularly shoes having improved step cushioning and ventilation of the foot of the wearer. More particularly still, it relates to improvements in midsoles.

2. Background Art

A large number of sport shoes such as running shoes have been disclosed in the art and many are on the market, displaying various forms of midsole for the purpose of improving the performance of athletic shoes. Many shaped outsoles, which are the only portions which actually contact the ground, have been proposed to provide shock absorption features.

Many items of prior art are known, such as U.S. Pat. No. 4,782,603 issued Nov. 8, 1988, to S. C. Brown. This patent provides a separate molded midsole encapsulating a series of parallel, spaced-apart tubes, disposed in a generally transverse position with regard to the length of a shoe. The parallel tubes are subject to compression with the step of the wearer, and the patent states that the tubes must be of sufficient resiliency and strength to resist collapse along their walls.

U.S. Pat. No. 4,316,332 issued Feb. 23, 1982, to Giese et al shows an outsole with hollow portions adapted to retain a shock absorbing material, and surrounded by a comparatively hard rim portions of the outsole.

U.S. Pat. No. 4,608,768 issued Sep. 2, 1986, to Cavanagh discloses the use of plugs which are inserted in an openwork support forming a midsole. The plugs are made of a material that is harder than that of the midsole.

U.S. Pat. No. 4,831,749 issued May 23, 1989, to Tsai discloses a footwear including a ventilating and massaging insole having a plurality of upper beads protruding upwardly to touch a wearer's foot and a plurality of lower beads protruding downwardly to ride on a footwear sole so that upon a depression of a wearer's foot on the insole, an air flow will be pumped through holes each hole formed between each upper bead and each lower bead for ventilating the wearer's foot and for massaging the same.

U.S. Pat. No. 4,685,224 issued Aug. 11, 1987, to Anger discloses the use of a labyrinth of ventilation channels between the top-sole of a shoe and the underside of the foot. This is intended to provide a pumping effect to move air around and ventilate the foot of the wearer.

U.S. Pat. No. 3,418,731 issued Dec. 31, 1968, to Anciaux discloses the use of an insole for a shoe provided with upper and lower surfaces of resilient material, and the upper surface of the sole being provided with a plurality of blind recesses, and the bottom surface being provided with corresponding projections so as to provide some ventilation during the action of walking.

The apparently closest background art encountered in the preparatory search is U.S. Pat. No. 4,845,863 issued Jul. 11, 1989, to Lin Yung-Mao which discloses the use of an insole or midsole in an active wear shoe. The specification deals with an impermeable midsole/insole construction with downwardly projecting resilient members, with those members being so placed and sized as to fit into receptables in the outsole to cushion the step of a wearer. The patent describes prior art deficiencies as follows:

- Thus, conventional midsoles do not offer anything in the way of independent suspension or deformation of various areas thereof, and further are suited to only a particular weight class or cushionability preference of wearers.
- The need for a midsole having a plurality of cushioning elements, each demonstrating an individual suspension and deforming independently from the remaining elements has generally been met by the custom midsole as disclosed in U.S. Pat. No. 4,733,483, Mar. 29, 1988, to Lin. However, it has been found that a flat outsole and midsole as disclosed therein have a tendency to create a springboard effect which causes the heel to bounce and vibrate. Unless the midsole fits perfectly into the cavity created within the shoe, there is also a tendency for the midsole to slip therein. Thus, a need has arisen for a midsole that has a plurality of cushioning elements with individual suspension that does not slip or vibrate.

Related U.S. Pat. No. 4,843,741 issued Jul. 4, 1989, also to Lin Yung-Mao, discloses similar structures, but additionally the downwardly depending plugs are provided with generally cylindrical cavities in each element, for the purpose of reducing the weight of the midsole.

For further background material, the reader is directed to an article in New Scientist of 15 July, 1989, by Alison Turnball "A Race for a Better Running Shoe", pages 42–44, and the immediately following article "How Elastic is a Running Shoe?" by Alexander and Bennett, pages 45 and 46. The authors discussed a recent trend in athletic shoe manufacture which aims to return to the runners some of the energy expended in taking each step. Many disclosures in the prior art are directed at means for achieving some return of energy in this fashion. Alexander and Bennett sum up their test results as follows:

- "The quality to look for in a shoe's heel is probably high compliance (or peak deformation), which will reduce the forces of impact. Looking at the same thing in a different way, the heel should be able to absorb the foot's kinetic energy without developing large forces, so large values in "peak deformation" and "work of deformation" are probably good.
- High energy return in the forepart of the sole does seem potentially important (see Table 3). But the figures from our tests for the percentage of energy returned still do not tell us how much energy a shoe returns. For that, we need to know how much energy was stored in the first place. The higher the compliance (or peak deformation) and the work of deformation, the more energy the sole stores as it is compressed. The higher the energy return, the more of that energy is recovered in the elastic recoil ."

SUMMARY OF THE INVENTION

The present invention is not directed to an objective of maximizing, or even obtaining, energy return to the walkers, but to the objective of shock-absorbing relatively gentle shocks of the steps of a normal walker and simultaneously ventilating the inside of the shoes worn.

In order to achieve this objective, it was found that an extremely soft material must be used for the plugs or columns of the present invention and that such plugs or columns must either point upwardly underneath a permeable and flexible top sole (sometimes called insole and socksole) or point downwardly from such top-sole, and just as importantly that such columns bulge significantly when compressed by the stepping action of a normal walker. The bulging action moves the air between the columns, thus ventilating the article of footwear and the foot through the top-sole. The softness of column material ensures a large value in "peak deformation" for a small value in "work of deformation."

It has been found, that such footwear is beneficial to the walker's joints and spinal column, in addition, of course, to the wearer's feet.

The present invention provides an article of footwear which includes in the sole area a number of vertical plugs or columns adapted to easily compress and bulge with each step of the wearer. This provides a shock-absorbing element of special value as it provides a comfortable base for the foot, fairly conformable to its sole contours, and cushions each step of the wearer. The compressibility of the thermoplastic material is such that the plugs are compressed and significantly deformed to cushion each step of the wearer, the deformation being accompanied by substantial bulging of the plugs, and the compression, bulging, and subsequent recovery of the shape of the plugs providing significant flow of air in the sole region, for ventilating the article of footwear.

One embodiment of the present invention provides a midsole or part midsole adapted for inclusion in an article of footwear, to provide step cushioning and ventilation for the wearer. The midsole or part midsole comprises a web portion adapted to extend along at least a portion of an outsole of the footwear and includes a cushioning element comprising a plurality of plugs projecting perpendicularly with respect to the plane of the web. Each plug is made of elastic but easily compressible thermoplastic rubber or the like. The plugs are distributed on a web so as to provide a comfortable base for the foot of a wearer to cushion each step of the wearer. The distribution, size and number of the plugs, and the compressibility of the material is such that the plugs are easily deformed and significantly compressed to cushion each step of the wearer, the compression being accompanied by substantial bulging of the plug. The compression, bulging, and subsequent recovery of the shape of the plug provides movement of the surrounding air, for ventilation of the article of footwear.

In another embodiment, the invention provides an article of footwear comprising an outsole and an upper, the outsole being provided with a plurality of upstanding plugs formed of resilient easily compressible material. The plugs are distributed on the outsole so as to provide a comfortable base for the foot of a wearer, and to cushion the steps of a wearer. The distribution, size and number of said plugs and the compressibility of the plastic is such that the plugs are deformed and significantly compressed to cushion each step of the wearer, the compression being accompanied by substantial bulging of the plug. The compression, bulging, and subsequent recovery of the shape of the plug providing a signicant flow of air along the outsole, for ventilation of the article of footwear.

BRIEF DESCRIPTION OF THE DRAWINGS

The preferred embodiments of the present invention will now be described in detail in conjunction with the annexed drawings, in which.

DESCRIPTION OF THE PREFERRED EMBODIMENTS

Figure 1:
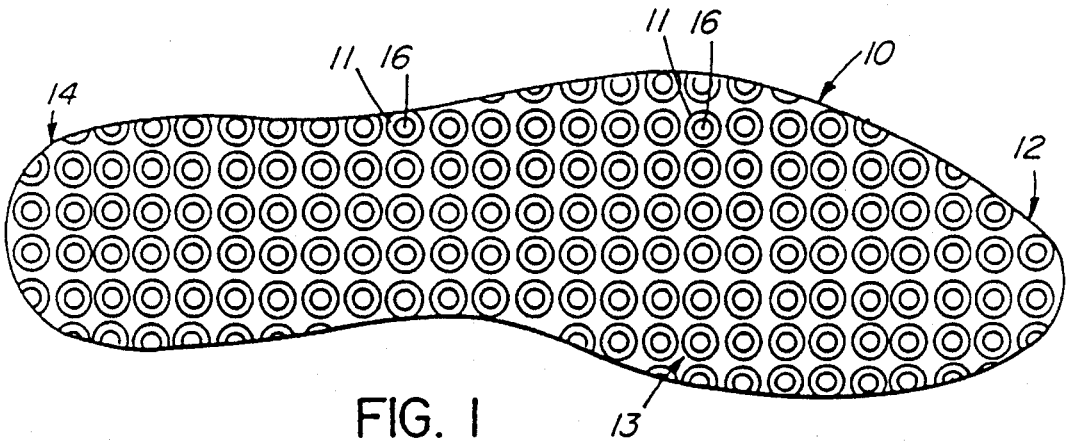
FIG. 1 shows a plan view of a midsole manufactured in accordance with a preferred embodiment of this invention.

With reference to FIG. 1 of the drawings, it shows a plan view of a midsole in the form of a separate and distinct drop-in insert shown generally as web 10 which is provided with a large number of upstanding plugs 11, These plugs are disposed in this embodiment along the entire midsole 10, which extends from the toe portion 12 through the ball portion 13 to the heel portion 14. In this embodiment each plug 11 is upstanding with respect to the web 10, and is affixed to the web at its proximal end. Each plug 11 in this embodiment displays a central aperture 16.

The entire midsole 10 is preferably manufactured by injection molding, in which case the web 10 of the midsole as well as the plugs 11 are of the same material, and in which case the web 10 is highly flexible but not air-permeable. Such midsole then would be suitable for inclusion in an article of footwear, where the web 10 is in contact with the top of the outsole and the plugs 11 project upwardly.

The most suitable material found for such midsole is that known as "Supersoft" thermoplastic resin available from GLS PLASTICS of Woodstock, Ill. 60098, U.S.A. (sold by them under item #G3294). The material is made from a thermoplastic compound known as "Kraton" (TM) supplied by the Shell Chemical Company. The preferred Kraton compounds (because they are softest having Shore A hardnesses [D-2240] of 27 and 34) are Kraton D-2104 and Kraton D-3226.

The resulting Supersoft thermoplastic yields a midsole material having Durometer readings below 30, and preferably in the vicinity of 20. Inspite of the softness of the resultant midsole, it still exhibits excellent elasticity and long life. Of course, there are other materials besides Kraton, such as Estane, polyvinyl chloride or rubber. The requisite characteristics of the material is that they yield plugs 11 that are easily compressible and significantly deformable (generally having Durometer readings below appr. 30) but that have long life and good elasticity in order to spring back to their original shape once compressive forces have been removed. The shape of the plugs 11 is not critical, and whether they are hollow or solid does not generally affect their deformability. In the embodiment of FIG. 1 they are made hollow in order to save thermoplastic resin.

Figure 2:
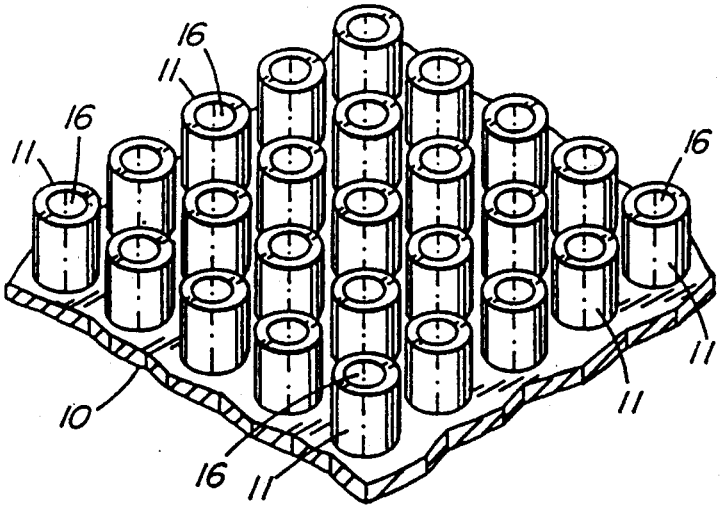
FIG. 2 shows a perspective view of a portion of a web shown in FIG. 1.
Figure 3:
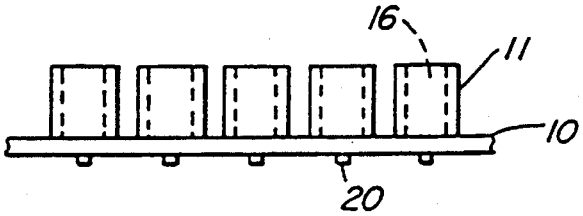
FIGS. 3, 4, and 5 are side elevations of a portion of web as shown in FIG. 2, illustrating three embodiments of the upstanding plugs of the invention.
Figure 4:
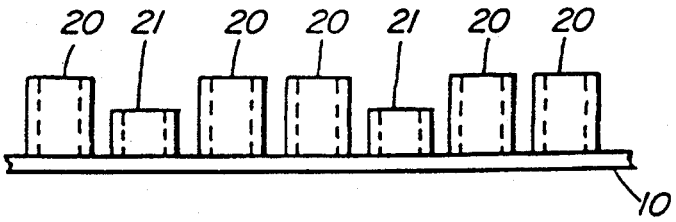

Turning now to FIGS. 2 and 3, these show portions of the midsole shown in FIG. 1 in perspective view and side elevation respectively. In FIG. 3 it can be seen that this embodiment is provided with lower projections 20, which provide a small amount of ventilation below the midsole. In FIG. 4 the plugs are shown as items 20 and 21. It will be seen that in the embodiments shown in FIG. 4, the plugs are of varying thickness (i.e. height ). Such thickness or height is of course discretionary, but values below 10 mm would appear reasonable. The plugs may have a height between 3 mm and 10 mm.

Figure 5:
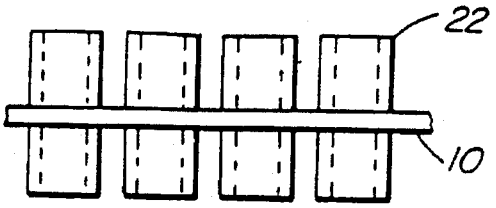

In FIG. 5 it will be seen that the plugs 22 are held in place in the midsole by a web 10 which is centrally located with respect to the plugs 22. This, of course, adds to cushionability of shocks.

In FIGS. 3, 4 and 5, the central apertures 16 are shown in plugs 11, 20, 21, and 22 as dotted lines.

Figure 6:
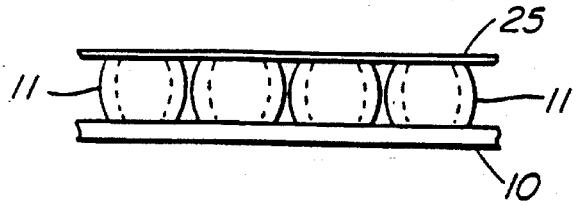
FIG. 6 shows a different embodiment of a web, provided with a sock-sole.

FIG. 6 shows an embodiment in which a portion of midsole as shown in FIG. 3 is provided with a top web 25, which suitably can be prepared of porous material, or it can be a perforated material, thereby providing for some movement of air. In this figure, the plugs 11 are shown compressively deformed and bulging.

Figure 7:
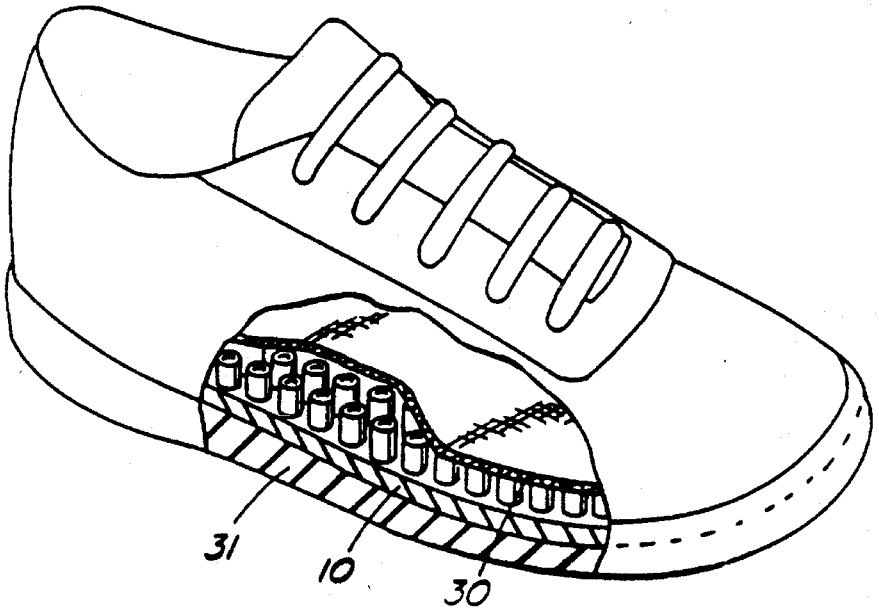
FIG. 7 shows a cut-away view of a complete shoe embodying one aspect of this invention.

FIG. 7 shows a cut-away view of a shoe embodying one form of the present invention, in which the midsole shown in FIG. 1 is in place on top of outsole 31 in a shoe. A flexible, air-permeable top-sole 30 is in place over the midsole.

Figure 8:
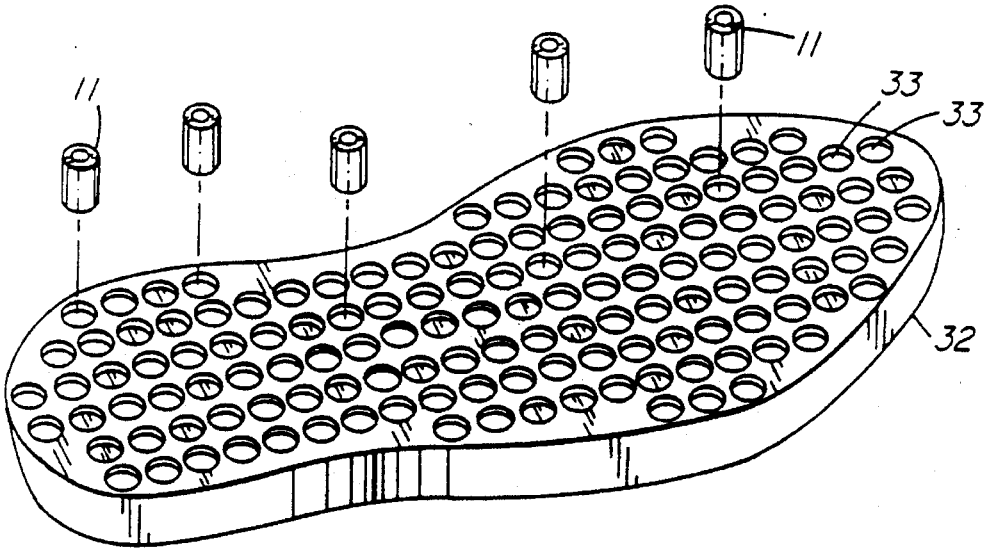
FIG. 8 shows a further embodiment of the inventive concept employing the compressible plugs.

FIG. 8 shows a variation wherein the outsole 31 in the embodiment shown in FIG. 7 is replaced by outsole 32, which is provided with a multiplicity of pockets 33 adapted to receive and retain plugs 11 of the type discussed above, thus eliminating the need for the web 10 to retain these plugs in place. Plugs 11 may be retained permanently in holes 33 by adhesion means, or any other suitable means.

Figure 9:
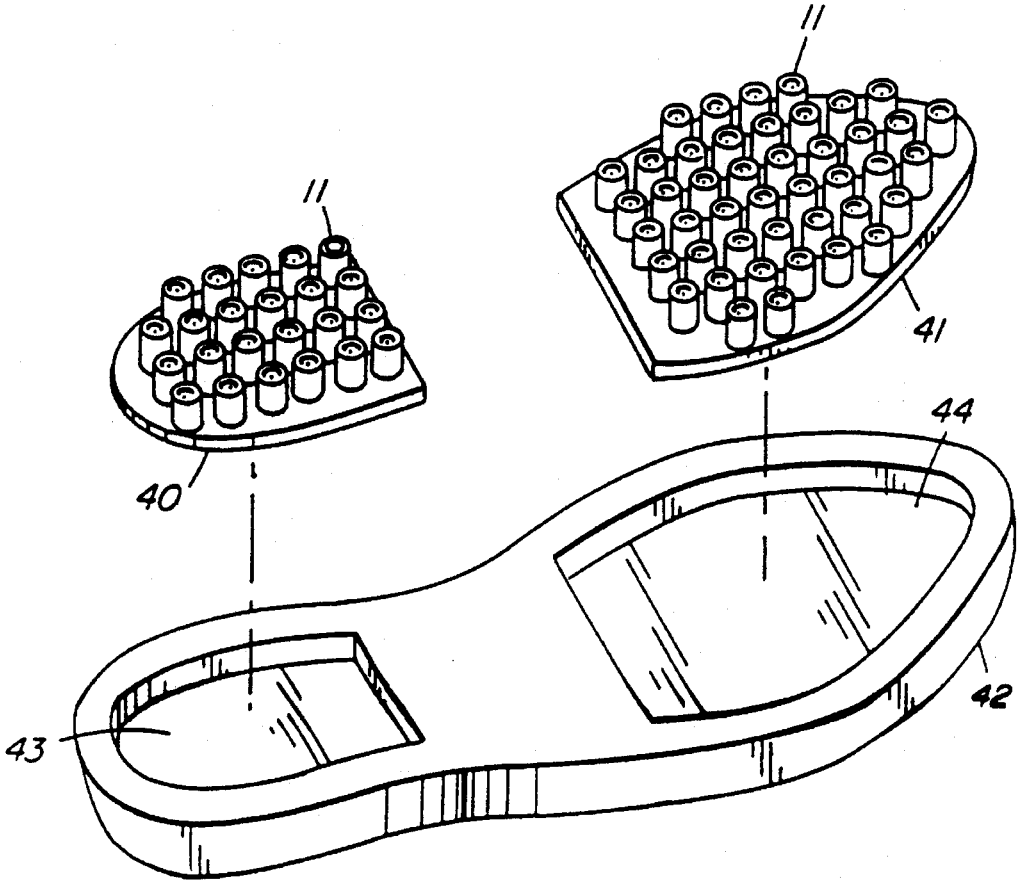
FIG. 9 shows an outsole provided with cavities or spaces for installation of partial midsole sections of the type shown in FIG. 2.

FIG. 9 shows an embodiment wherein an outsole 42 is provided during manufacture with cut-away portions 43 and 44 so that suitably sized and shaped sections 40 and 41 of web such as shown in FIGS. 2, 3, etc. fit directly into the spaces, thereby taking up less vertical room in the interior of the footwear. The web sections 40 and 41 comprising the "midsole" are also thus held effectively in place against lateral movement. It is, of course, possible to provide only one of the sections 40 and 41.

Figure 10:
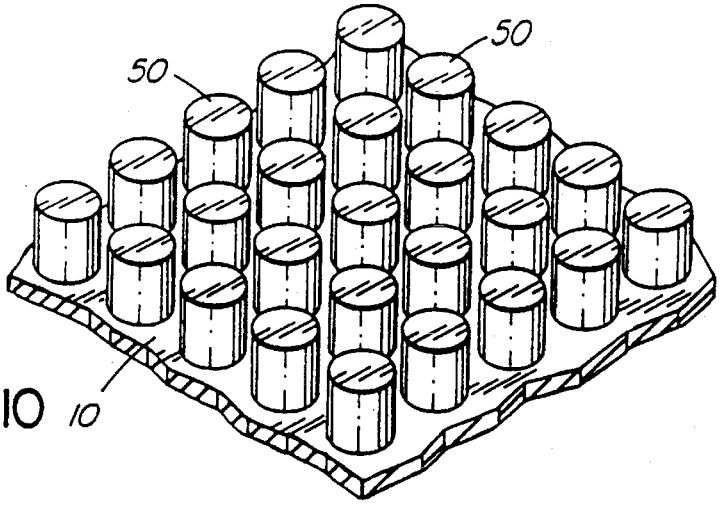
FIGS. 10 and 11 show sections of web such as shown in FIG. 2, with variations in the shape of the plugs.

FIG. 10 illustrates an embodiment of the invention in which a section of the web 10 such as shown in FIG. 2 is provided with plugs 50, which are solid plugs instead of the hollow plugs 11 shown in FIG. 2. It may be necessary to use even softer material for the plugs 50, in order to maintain the desired high degree of compressibility, yielding a suitable extent to compression under the step of a wearer, while allowing the plug to bulge, and recover.

Figure 11:
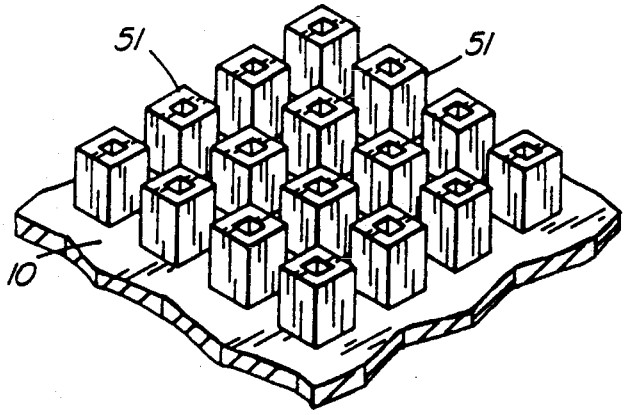

FIG. 11 shows still another embodiment of the present invention in which a portion of the web 10 similar to that in FIG. 2 is provided with upstanding plugs 51 which are hollow, but essentially square in cross section. These various design parameters may be varied in order to achieve a maximum performance. Such variables as the resiliency of the plastic material, the height and shape of the plugs, the distribution and number of the plugs per unit of area, variations in the heights of various plugs, or rows of plugs, hollow versus solid plugs, and the thickness of the walls in such hollow plugs, can all be varied for the purpose of achieving the objectives of the present invention. Satisfactory results have been obtained using plugs having a cross-sectional area of appr. 0.5 $cm^2$ with a wall thickness of 1 to 3 mm if hollow.

Figure 12:
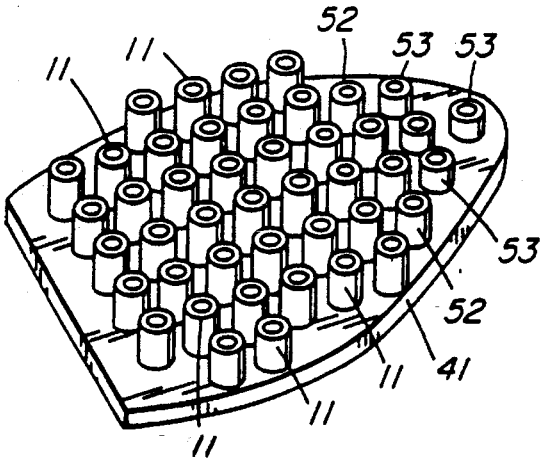
FIG. 12 shows a toe portion 41 of a web as shown in FIG. 9, in which the forwardmost plugs 53 are somewhat progressively shorter in length to suit a specific installation.

FIG. 12 shows a further variation of the invention, in which the plugs are not all of the same length, wherein an insert 41 similar to the one shown in FIG. 9, for the toe portion of a shoe or sandal. As may be seen from FIG. 12, the plugs 11 grow progressively shorter through plugs 52 to 53 as they approach the toe. The lengths of the plugs may be varied in any suitable manner to accommodate the geometry of the inside of the item of footwear.

Figure 13:
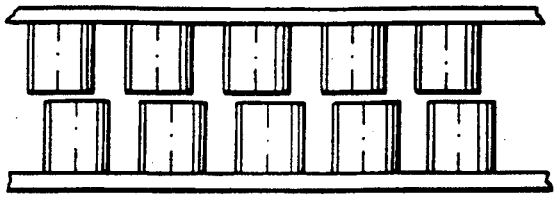
FIG. 13 shows a variation of the invention.

FIG. 13 shows a further embodiment of a portion of a web in accordance with the present invention, wherein the plugs in the upper and lower webs are facing each other for added cushioning. Again, the upper web should be flexible and preferably also air-permeable.

Figure 14:
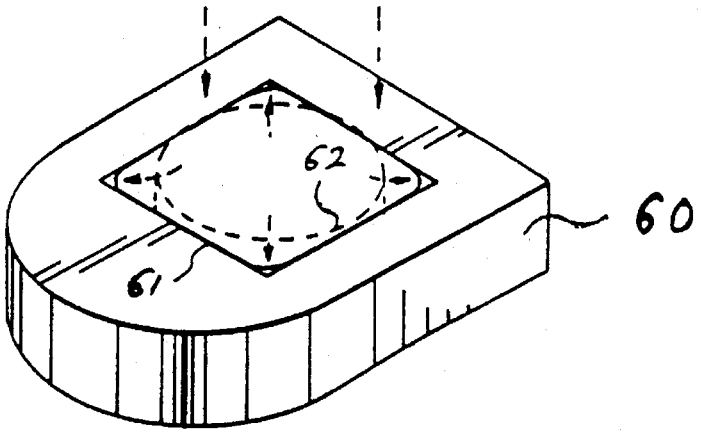
FIG. 14 shows a partial midsole construction in the heel of a shoe according to the present invention.

In FIG. 14, the inner part of a heel section 60 of an outsole or midsole is shown which has a square recess 61 in it. The recess 61 has inserted therein a single large diameter cylindrical plug 62 which is shown in its fully compressively deformed position for explanatory purposes. As may be seen, the compressive deformation is causing the plug 62 to bulge but, of course, only to partially fill in the space between its circumference and the corners of the recess 61, thus pumping air upwards every time the plug 62 bulges.

Figure 15:
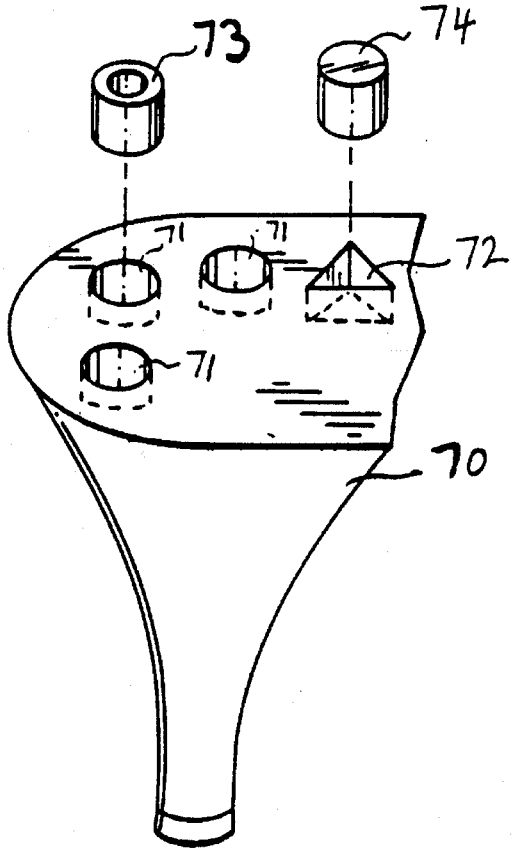
FIG. 15 shows a variation of the present invention as applied to the heel of a women's shoe or sandal.

In FIG. 15, a heel section 70 of a women's shoe or sandal is shown, which has shown in it, for purposes of explanation, cylindrical recesses 71 and rectangular recess 72. Of course, any other polygonal recess may be used. Plugs 73 and 74, when installed in the recesses stick out as desired due to the recesses being shallower than the thickness or length of the plugs.

What is claimed is:

1. A separate and distinct, readily removable drop-in insert in combination with an article of footwear, said drop-in insert being separate from a wall portion of the article of footwear so as to be readily removed therefrom, said drop-in insert comprising:

a web;

a plurality of hollow, substantially cylindrical plugs of integral construction with said web and extending substantially vertically from at least one side of said web, said web and said hollow plugs being formed of the same material so as to have a substantially uniform hardness value, said material comprising a resilient, extremely soft, deformable thermoplastic having a shore A (D-2240) hardness value of less than about 35;

wherein each of said hollow, substantially cylindrical plugs has a wall portion with spaced apart inner and outer surfaces and has an end surface spaced from said web, said end surface defining a generally flat Working area and having an opening therein with a diameter equal to a diameter of said inner surface;

said hollow plugs having a height of at least about 3 mm; and said hollow plugs being sufficient in number and design to permit significant deformation of said thermoplastic material and air compression of air trapped within said hollow plugs along a height dimension of said hollow plugs accompanied by simultaneous significant bulging deformation in the wall portion perpendicular to the height dimension of said hollow plugs when said drop-in insert is in use in the article of footwear to attendantly provide for shock absorption and ventilation.

2. The insert according to claim 1, wherein said thermoplastic material has a Shore A (D2240) hardness value of about 20.

3. The insert according to claim 1, wherein said thermoplastic material is selected from the group consisting of Kraton™ D2104, Kraton™ D-3226, Estane™, polyvinyl chloride, and rubber.

4. The insert according to claim 1, wherein said thermoplastic material comprises Kraton™ as a base material.

5. The insert according to claim 1, wherein said hollow plugs vary in height.

6. The insert according to claim 1, wherein said web is disposed generally in a front section of the article of footwear.

7. The insert according to claim 1, wherein said web is sole shaped.

8. The insert according to claim 7, wherein said hollow plugs vary in height such that the hollow plugs in a toe portion of said article of footwear are shorter than the remaining hollow plugs.

9. The insert according to claim 1, wherein said web is disposed generally in a heel section of the article of footwear.

10. The insert according to claim 1, wherein each of said hollow plugs is closed at an end opposite to said end surface defining said working area so as to prevent air from passing therethrough.

11. The insert according to claim 1, wherein said height of said hollow plugs is in a range of from about 3 mm to about 10 mm.

12. The insert according to claim 1, wherein said drop-in insert comprises two separate portions, with a first portion positioned in a front section of said article of footwear and a second portion positioned in a heel section of said article of footwear, said first and second portions being free of any connection therebetween.

13. The insert according to claim 1, wherein said generally flat working area of each of said hollow, substantially cylindrical plugs has a cross-sectional area of approximately 0.5 $cm^2$.

* * * * *